US006717346B2

(12) United States Patent
Breuninger

(10) Patent No.: US 6,717,346 B2
(45) Date of Patent: Apr. 6, 2004

(54) CRT DISPLAY MATRIX THAT EMITS ULTRAVIOLET LIGHT

(75) Inventor: John Friedrich Breuninger, Strasburg, PA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 364 days.

(21) Appl. No.: 09/728,601

(22) Filed: Dec. 1, 2000

(65) Prior Publication Data

US 2002/0067119 A1 Jun. 6, 2002

(51) Int. Cl.[7] ..... H01J 29/10
(52) U.S. Cl. ..... 313/467; 313/463
(58) Field of Search ..... 313/364, 467, 313/472, 468, 495, 474, 496, 422

(56) References Cited

U.S. PATENT DOCUMENTS 4,565,946 A 1/1986 Barrett et al. ..... 313/408
5,028,501 A * 7/1991 Ritt et al. ..... 430/23
5,256,463 A * 10/1993 Osaka et al. ..... 428/77
5,808,409 A * 9/1998 Matsuda et al. ..... 313/486
5,821,685 A * 10/1998 Peterson ..... 313/467
5,866,977 A 2/1999 Lee et al. ..... 313/463
5,928,821 A * 7/1999 Garrity et al. ..... 430/23
6,071,657 A * 6/2000 Kusunoki et al. ..... 430/28
6,077,458 A * 6/2000 Shiiki et al. ..... 252/301.4 R
6,081,069 A * 6/2000 Matsuda et al. ..... 313/461

* cited by examiner

*Primary Examiner*—Haissa Philogene
*Assistant Examiner*—Minh Dian A
(74) *Attorney, Agent, or Firm*—Mayer Fortkort & Williams, PC; Michael P. Fortkort, Esq.; Karin L. Williams, Esq.

(57) ABSTRACT

An additional phosphor-excitation mechanism improves the light output of a visible-light emitting phosphor.

One excitation mechanism indirectly excites the visible-light emitting phosphor by first striking a non-visible-light emitting particle (such as an ultra-violet-emitting phosphor) with an electron beam, which then emits non-visible radiation that strikes a visible-light emitting phosphor. The non-visible-light emitting particles can be disposed behind and/or adjacent to die visible-light emitting phosphors. A second mechanism directly excites the visible-light emitting phosphor by directly striking the visible-light emitting phosphor with an electron beam. Thus, the same visible-light emitting phosphor is activated by the first indirect mechanism as well as the second direct mechanism.

15 Claims, 12 Drawing Sheets

CRT DISPLAY MATRIX THAT EMITS ULTRAVIOLET LIGHT

BACKGROUND OF THE INVENTION

The present invention relates generally to display devices, and more particularly to display devices that utilize electron-beam excitation of a phosphor, such as cathode ray tubes having multiple color stripes or dots.

In a three-color cathode ray tube (CRT), the traditional phosphors used are (1) zinc-sulfide doped with copper, aluminum and sometimes gold for the green color; (2) zinc-sulfide doped with silver for the blue color; and (3) yttrium-oxysulfide doped with europium for the red color. The zinc-sulfide based green and blue phosphors are both about 20% efficient in light-energy transmission (i.e., conversion of energy from the electron beam to energy illuminated by the excited phosphor), whereas the red phosphors containing yttrium-oxysulfide doped with europium are approximately 11% efficient in light energy.

The phosphors traditionally used in CRT manufacture typically consist of a host crystal and an activator. For example, in the case of traditional CRT red phosphors, some europium atoms are diffused into the yttrium oxysulfide molecular matrix (in percentages typically 6% or lower). Hence, yttrium oxysulfide is known as the "host crystal," while europium is called the "activator." Each particular phosphor is excited by different forms of energy, in differing concentrations and efficiencies.

As consumers demand increased resolution CRTs, designers have responded by reducing pixel size to increase pixel density. As CRT phosphor display pixel sizes are reduced to increase resolution, the image brightness decreases accordingly. Therefore, there is a need in the art to increase image brightness in CRTs, as well as in other display devices.

FIGS. 1A and 1B are CIE (Commission Internationale d'Eclairage) chromaticity diagrams, which are common ways of representing colors. The CIE diagrams define colors using X and Y coordinates instead of wavelengths or a range of wavelengths of emitted light. All colors that plot in the same location in the color space of the chromaticity diagram will look exactly the same to a standard observer. The perimeter values on the horseshoe curve 101 represent the positions in the chromaticity diagram of all pure colors, i.e., colors with only one wavelength in their spectral distribution. Since all visible colors are made with one or more of these pure colors, all visible colors are inside the region delimited by the curve 101.

The area within triangle 103 represents the potential gamut of colors realizable using conventional P22 red, blue and green phosphors for each pixel of a CRT. The vertices of this triangle are denoted by the primary color used for the display. Any color within the area of triangle 103 can be generated through the use of the three primary color vertices or combinations of the same.

Efforts to improve color CRTs include adding an additional color to the current three color CRT, Referring now to FIG. 2, a CIE is shown in which a blue-green phosphor is added to the red, green and blue phosphors of FIGS. 1A and 1B. This produces a quadrilateral 202 having the same green, red and blue vertices as the three-color displays of FIGS. 1A and 1B, plus a fourth vertex corresponding to the blue-green phosphor. The area bounded by the quadrilateral 202 represents the range of visible colors attainable by combining one or more of the four phosphors. It is seen that the range of visible colors is markedly expanded relative to the tri-color display of FIGS. 1A and 1B. Diagonal 204 is drawn to clearly delineate this expanded color range.

Research regarding suitable cathodoluminescent phosphors for a fourth color has determined that a majority of the possible candidates (e.g., $Y_2O_2S$:Pr, $Y_2O_2S$:Tb, $SrGa_2S_4$:$Eu^{2+}$, and LaOBr:Tb) exhibit a good chromaticity color point, but also yield a lower light-energy transmission efficiency—in the realm of approximately 6% or less. Also, a four-color phosphor stripe will be approximately 75% the width of a three-color stripe, while still possessing approximately the same number of phosphor-columns sets. Consequently, a display that utilizes a four-color system will not be as bright as a three-color system. For example, under a monochrome raster, picture brightness will decrease by as much as 25%.

Hence, advancements such as those in connection with high-density displays and four-color displays require corresponding increases in phosphor brightness. Prior improvements in phosphor brightness in color point have been made through phosphor development (e.g., rare-earth phosphors replacing zinc-cadmium phosphors for red color), electron-beam intensity, panel-glass tint, metal-back reflectivity, phosphor-particle packing, phosphor pigments, phosphor particle size, increases in aperture-mask slit size and aperture grill versus shadow mask, black matrix and other milestones. These improvements, however, are generally not sufficient to improve the brightness to the point desired in a four-color cathode ray tube or in a high-density three-color cathode ray tube, without sacrificing device reliability.

As a specific example, increases in phosphor brightness can be achieved through the use of higher power electron guns. Higher power electron guns, however, are more susceptible to high voltage arcing and can also decrease the life expectancy of the phosphor than lower power electron guns. Thus, it is desirable to improve the energy efficiency of the energy conversion from an electron beam to illumination of the excited phosphor.

U.S. Pat. No. 5,821,685 discloses a display with an ultraviolet emitting phosphor. This display uses an electron beam to excite an electron-beam-exciting ultraviolet emitting phosphor, which exclusively excites an ultraviolet-exciting visible-light-emitting phosphor. This two-stage excitation was designed to improve brightness in low-voltage displays and is not sufficient to adequately improve the image brightness in high-voltage displays, such as CRT displays.

The present invention is therefore directed to the problem of increasing image brightness in a cathode ray tube.

SUMMARY OF THE INVENTION

The present invention solves these and other problems by providing an additional phosphor-excitation mechanism to improve the light output of the visible-light emitting phosphor. The present invention provides the ability to improve the light output of not only a four-phosphor arrangement, but also for the traditional three-phosphor display or even a two-color or monochrome CRT, such as a black-and-white (black-and-green, black-and-amber, etc.) CRT. In addition, the present invention can improve the light output for CRTs employing more than four colors.

According to one exemplary embodiment of the present invention, one excitation mechanism indirectly excites the visible-light emitting phosphor by first striking a non-visible-light emitting particle (such as an ultraviolet-emitting phosphor) with an electron beam, which then emits non-visible radiation that strikes a visible-light emitting phosphor, thereby activating the visible-light emitting phosphor. A second mechanism simultaneously excites the visible-light emitting phosphor by directly striking the visible-light emitting phosphor with an electron beam. Thus, the same visible-light emitting phosphor is activated by the first indirect mechanism as well as the second direct mechanism.

According to another exemplary embodiment, image brightness can be optimized by disposing non-visible-light emitting particles behind and next to the visible-light emitting phosphors. The result is three different excitation modes—first from a direct activation by the electron beam; second from an indirect activation by non-visible radiation output by the non-visible-light emitting particles disposed behind the visible-light emitting phosphors; and third from an indirect activation by non-visible radiation output by the non-visible-light emitting particles disposed next to the visible-light emitting phosphors.

DETAILED DESCRIPTION

The present invention provides an additional excitation mechanism to improve image brightness of numerous display devices that utilize electron-beam excitation of a phosphor, such as cathode ray tubes and field emission displays. For example, the present invention is suitable for use in essentially any cathode ray tube (CRT), including but not limited to monochrome CRTs, two-color CRTs, three-colored CRTs, four-colored CRTs, multi-colored (greater than four) CRTs and high-definition CRTs. These CRTs have many applications, such as computer monitors, television sets, displays for instrumentation, and so forth.

Figure 1A:
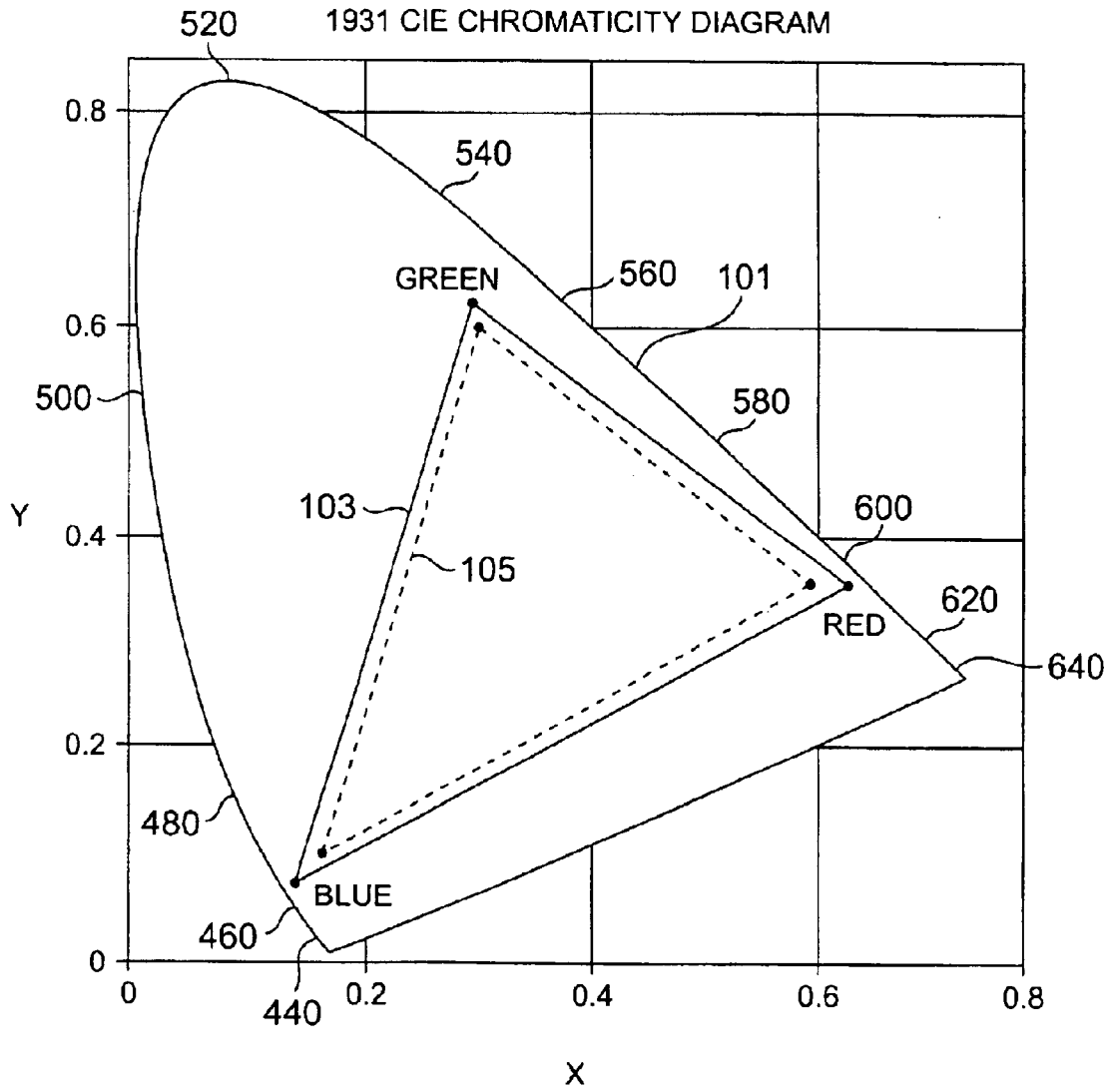
FIG. 1A (PRIOR ART)
FIGS. 1A–B are CIE chromaticity diagrams illustrating the range of colors displayable with a typical three-color display.
Figure 1B:
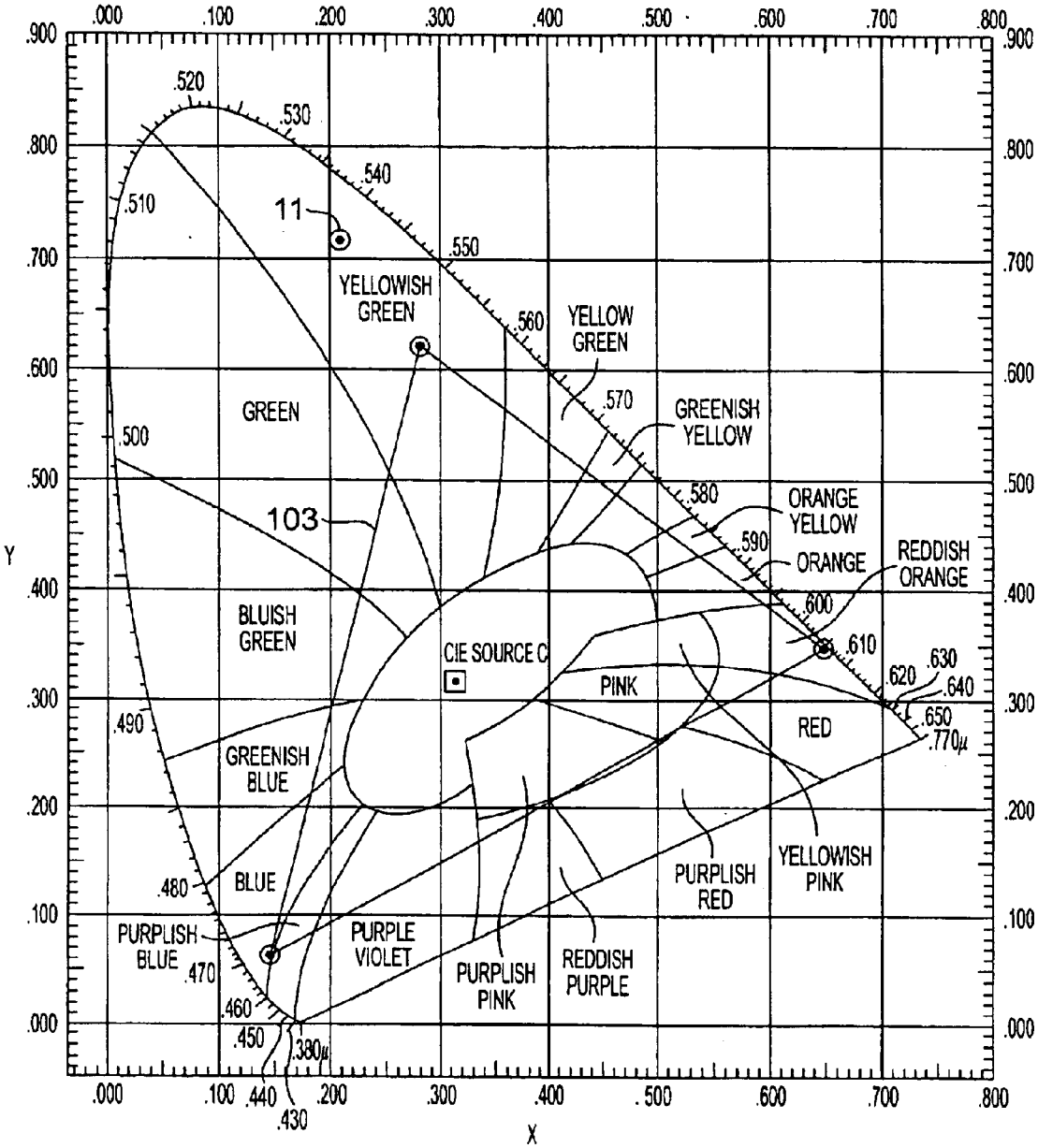
FIG. 1B (PRIOR ART)
Figure 2:
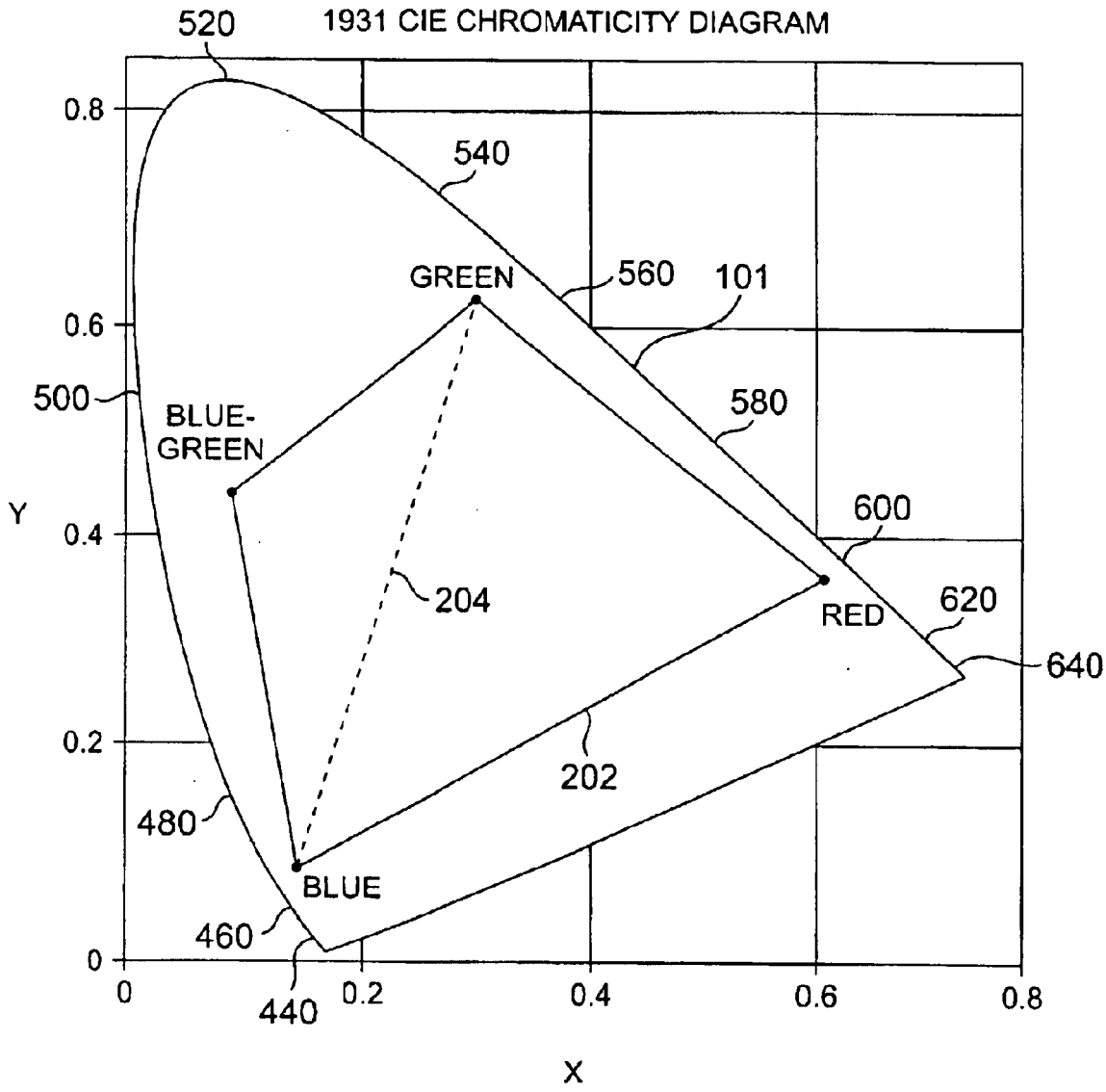
FIG. 2 is a CIE chromaticity diagram illustrating an example of the range of colors displayable with a four-color display.
Figure 3:
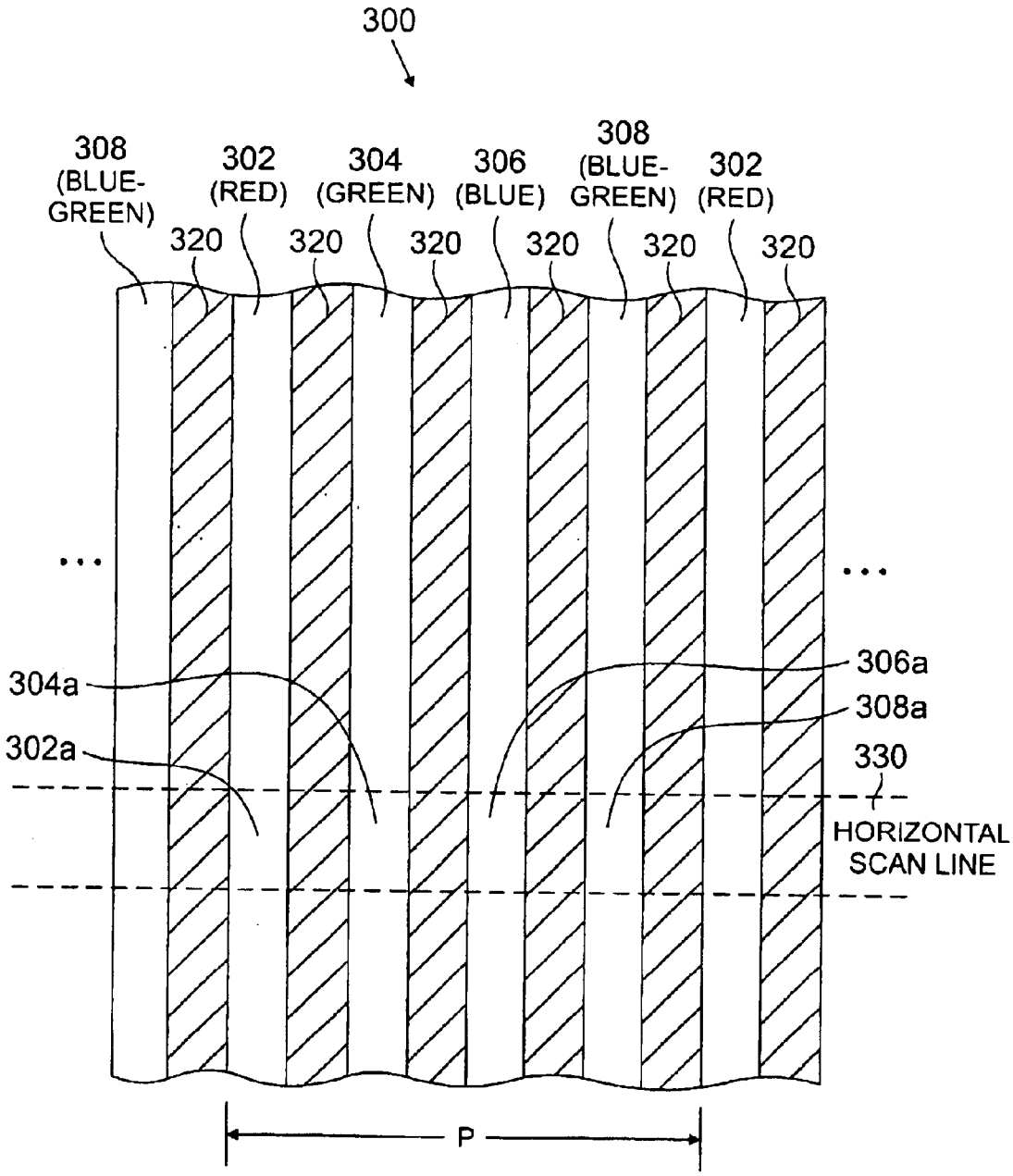
FIG. 3 illustrates a portion of a striped phosphor screen appropriate for the practice of the presenting invention.

Phosphor screens appropriate for use in connection with the present invention include, for example, both phosphor screens with striped phosphors and phosphor screens with dot-type phosphors. With reference to FIG. 3, an embodiment of a phosphor screen 300 in accordance with an embodiment of the invention is illustrated. Phosphor screen 300 is composed of repetitively alternating red, green, blue, and blue-green phosphor stripes 302, 304, 306, 308, respectively. The phosphor stripes, which are oriented vertically, are separated by graphite stripes 320 as found in a conventional phosphor screen based on the Trinitron (trademark of Sony Corporation) CRT design. (A conventional Trinitron-type phosphor screen uses alternating red, green and blue phosphor stripes.) An advantage of a phosphor screen with phosphor stripes, as opposed to discrete phosphor dots, is that the striped design alleviates the requirement for accurate registration of a shadow mask in the vertical direction.

Phosphor screen 300 forms part of a CRT that scans four electron beams horizontally across the phosphor stripes, with each electron beam striking only those phosphor stripes of a designated color. The selective excitation of the phosphor stripes can be achieved using either a shadow mask or an aperture grill suitably positioned between phosphor screen 300 and an electron gun(s) generating the four beams or even by a pulsating electron beam with no traditional shadow mask. Hence, excitation of the phosphor stripes can be accomplished in essentially the same manner as in a conventional Trinitron-type CRT, with the exception of four electron beams being scanned instead of three, and with the shadow mask or aperture grill designed accordingly to achieve the selective electron bombardment of the four phosphor colors. For instance, in any given horizontal scan line 330, a first electron beam will impinge only on the red phosphor stripes 302, a second electron beam impinges only on the green phosphor stripes 304, and so forth. The excitation of four adjacent phosphor stripe portions 302*a*, 304*a*, 306*a*, 308*a* by the respective electron beams results in a desired color being produced for a resulting pixel as a weighted combination of the four phosphor colors. That is, phosphor stripe portions 302*a*, 304*a*, 306*a*, 308*a* constitute a pixel capable of producing, in combination, a desired color perceivable by a human observer.

Figure 4A:
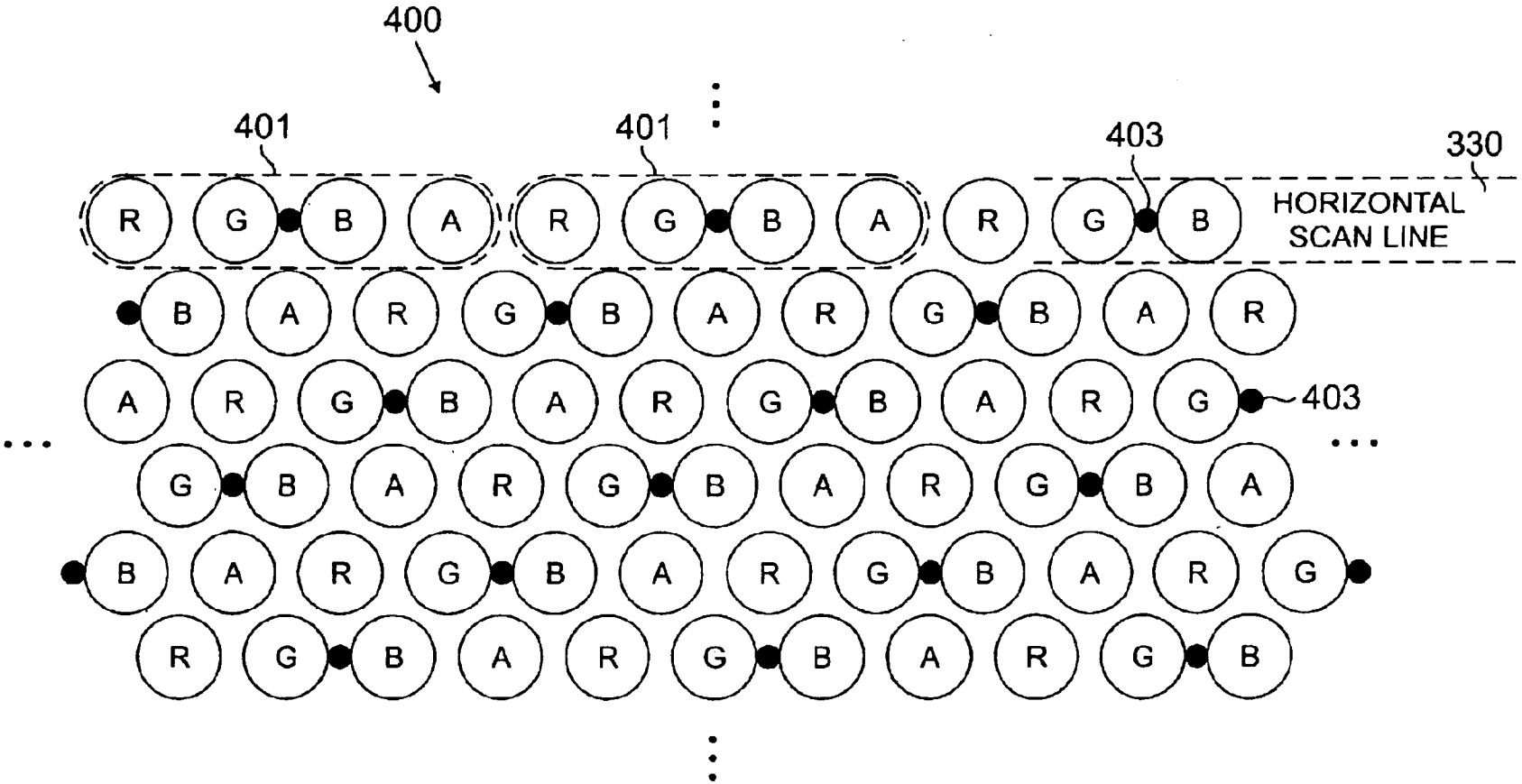
FIGS. 4A–B illustrate a portion of a dot-type phosphor screen appropriate for practicing various embodiments of the present invention.

Referring now to FIG. 4A, another embodiment of a phosphor screen in accordance with the invention is illustrated. Phosphor screen 400 is a four-phosphor color dotted screen having blue (B), green (G), red (R) and blue-green (G/B) phosphor dots constituting each pixel such as pixels 401. Phosphor screen 400 may be used, for example, as part of a television or computer CRT that employs four electron beams to excite the respective phosphor dots, with each gun dedicated for excitation of one of the phosphor colors. A shadow mask (not shown) disposed in proximity to phosphor screen 400 enables the respective electron gun beams to impinge upon the intended phosphor dots of the corresponding colors. In this example, the electron beams are converged in horizontal scan lines, such as 330 encompassing one row of phosphor dots. In this manner, pixels such as 401, 403 are excited to produce a visible color that is a function of the respective energies of the four electron beams striking the phosphor dots. The corresponding shadow mask aperture is depicted as elements 403, which is approximately centered behind each pixel 401. Note that the electron beams can alternatively be configured to scan in vertical scan lines. In either case, the four electron beams may be formed with a single four-cathode electron gun, or with four separate electron guns having an in-line or quadrilateral arrangement.

Figure 4B:
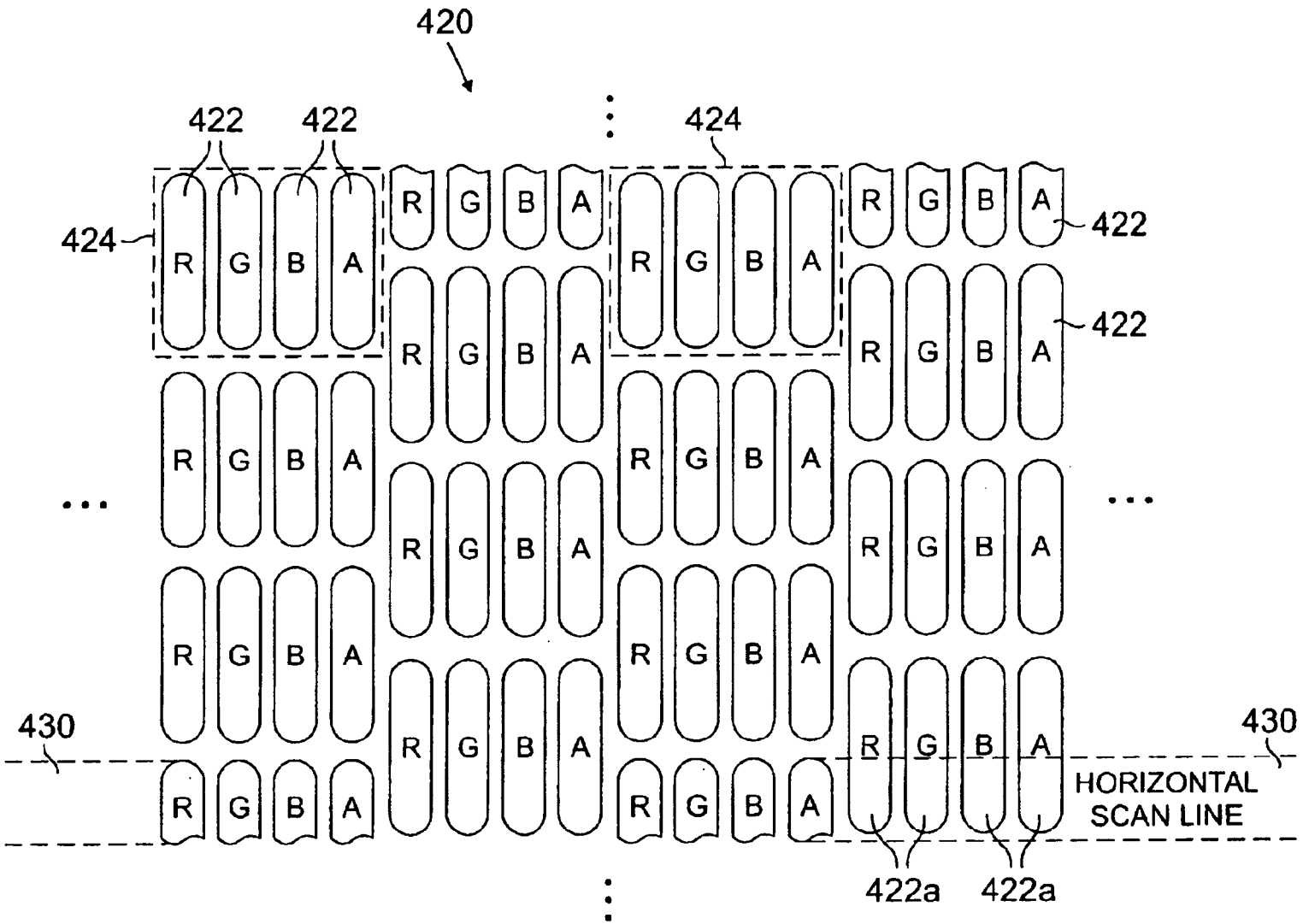

FIG. 4B depicts a standard CRT-TV display format 420 that can be used for various embodiments of the present invention. As shown therein, the colors 422 are laid out in column groups 424 that are shifted with respect to each other. A horizontal scan line is represented by element 430 between the dotted lines.

Dual Phosphor Excitation Mechanism

According to one aspect of the present invention, two distinct activation mechanisms can activate the same visible-light emitting phosphor particle. In a first activation mechanism, an electron beam directly activates the visible-light emitting phosphor particle, which electron beam is output by an electron gun in a conventional manner.

A second activation mechanism activates the same visible-light emitting phosphor particle indirectly. The second mechanism employs two-stage indirect phosphor particle activation.

In the first stage, an electron beam from the electron gun strikes a non-visible-light emitting particle, which when activated outputs non-visible-light radiation. An example of the non-visible-light emitting particle includes an ultraviolet-light emitting phosphor particle.

The second stage results from energy output by the non-visible-light emitting particle. When energy from the electron beam strikes the non-visible-light emitting particle, the non-visible-light emitting phosphor outputs non-visible radiation that strikes a visible-light emitting phosphor particle that is in proximity to the non-visible-light emitting particle.

The same visible-light emitting phosphor particle may thereby be simultaneously activated directly by energy from an electron beam, which is, for example, the same electron beam that activated the non-visible-light emitting phosphor. Thus, the visible-light emitting phosphor particle is thereby activated jointly by two mechanisms, which combine to result in a higher visible-light energy output without an increase in the energy output by the electron gun.

In other words, the second excitation mechanism adds to the first excitation mechanism, thereby increasing the brightness of the visible-light emitting phosphor.

The combination of two excitation mechanisms results in a brighter illuminated phosphor than heretofore possible using either one of the two mechanisms by itself.

Side Embodiment

Figure 5:
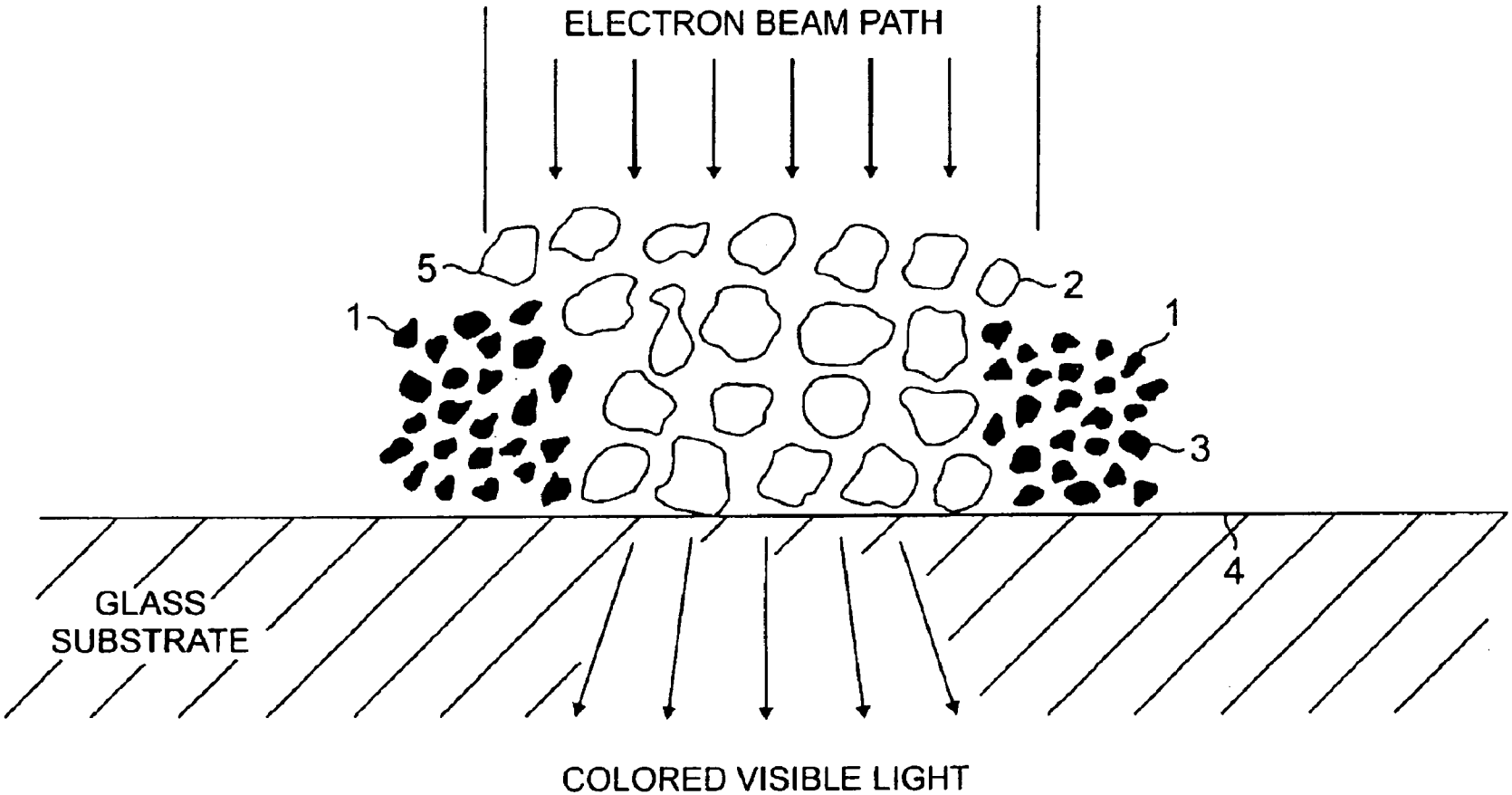
FIG. 5 depicts an exemplary embodiment of an electron beam interaction with visible-light emitting phosphor particles and non-visible-light emitting particles according to one aspect of the present invention.

There are multiple techniques for implementing the dual excitation mechanism of the present invention. Shown in FIG. 5, is one exemplary embodiment of the dual excitation mechanism. An electron beam strikes visible-light emitting phosphor particles 2 which comprise phosphor 5, for example, a stripe or dot-type phosphor as shown in FIGS. 3 and 4A, respectively. FIG. 4B shows a conventional CRT-TV display format in which the phosphor is laid out in stripes. On either side of the visible light emitting phosphor 5 are non-visible light emitting particles 3, such as ultraviolet-light emitting phosphor particles. The non-visible light emitting particles 3 comprise a matrix of particles 1, one exemplary embodiment of which is termed a UV-Matrix, as in this embodiment, where the particles are ultraviolet-light emitting phosphor particles. The matrix 1 can be in the form, for example, of the stripes 320 shown in FIG. 3 or it can occupy regions between blue (B), green (G), red (R) and blue-green (G/B) phosphor dots arranged in a pattern, for example, like that shown in FIG. 4A. The phosphor 5 and the particle matrix 1 are disposed behind on a glass substrate or glass panel 4.

In this exemplary embodiment, the non-visible-light emitting particles 3 are disposed adjacent to the visible-light emitting phosphor particles 2. In this embodiment, the energy from the electron beam strikes the non-visible-light emitting phosphor particles 3 and the visible-light emitting phosphor particles 2 simultaneously. This causes the visible-light emitting phosphor particles to directly emit visible light. This also causes the non-visible light emitting particles 3 to emit non-visible radiation that, at least some of which, reaches the visible-light emitting phosphor particles 2 within phosphor 5. The non-visible radiation further excites the visible-light emitting phosphor particles 2 causing them to increase the visible light output of the phosphor 5. By virtue of its position at the side of the phosphor, the matrix 1 of non-visible-light emitting particles 3 is sometimes referred to herein as a Side UV-Matrix.

Perhaps we should note that the original purpose of the traditional black matrix was to block potential overlap of two adjacent electron beams due to imperfect register between the electron gun and the phosphor stripe. In other words, without the black matrix, the electron beams must only hit the center of a corresponding phosphor stripe so as to not inadvertently strike the adjacent stripe of another color. The black matrix allows for a larger electron beam area to strike each individual phosphor stripe. If an electron beam corresponding to green stripes catches the edge of neighboring blue stripes, the black matrix will block the undesired light emitted by the blue stripe, so long as the overlap does not extend too far from the edge of the adjacent stripe.

Figure 10:
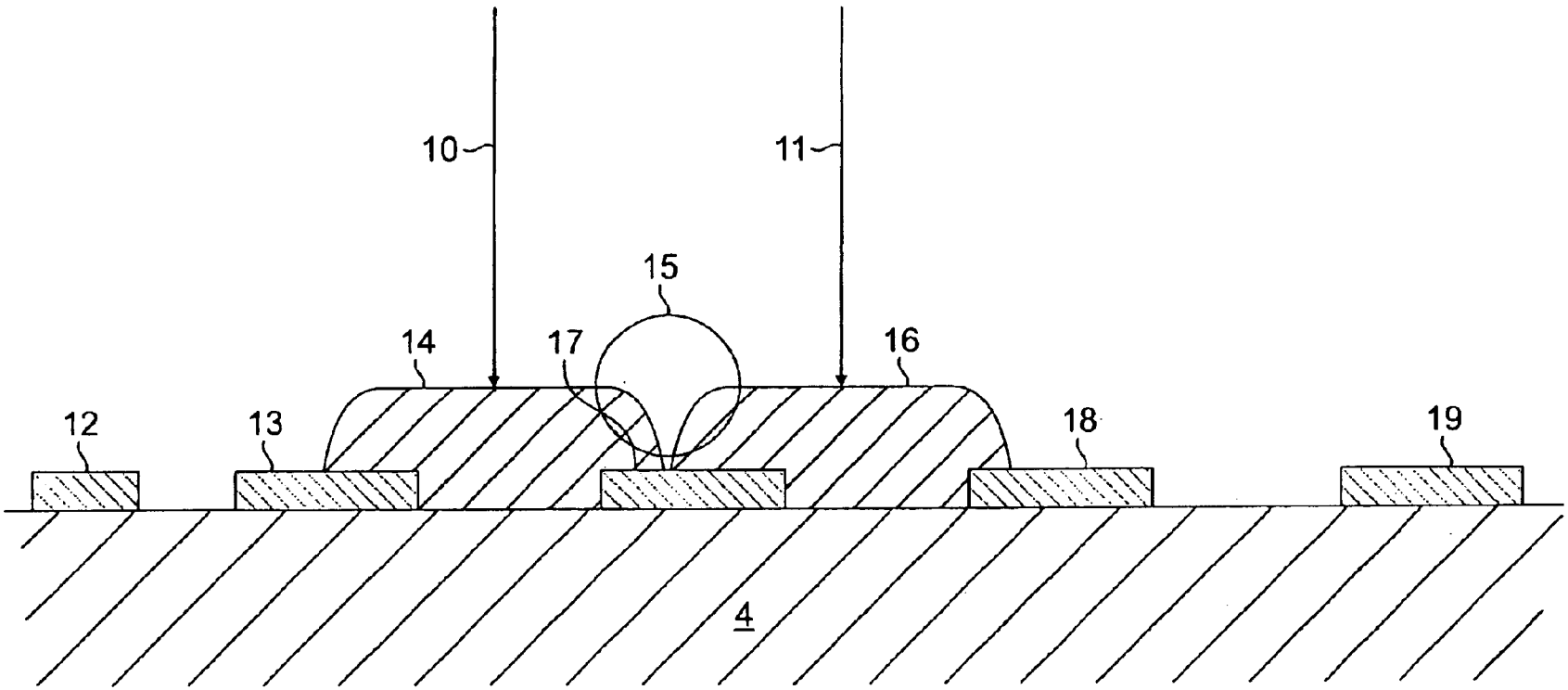
FIG. 10 depicts the interaction of adjacent color stripes and the electron beam and the UV-Matrix.

Referring to FIG. 10, shown therein is the overlap point 15 that occurs between adjacent colored phosphors 14 and 16, which could be blue and green, for example. Black matrix stripes 12, 13, 17, 18 and 19 are disposed on panel glass 4. Electron beams 10 and 11 strike phosphors 14 and 16, respectively.

For the UV-Matrix, undesired visible light from electron beam overlap will still be absorbed, but the electron beam itself will excite UV phosphor within the black matrix. This UV phosphor will excite ambient light-emitting phosphors, but the visible light will still be confined to the window between the black matrix stripes.

Embodiment of the Non-Visible-Light Emitting Particle

One possible implementation of the non-visible-light emitting particle is an ultraviolet-light emitting phosphor particle. Other possible implementations include any particle that outputs non-visible radiation upon receipt of energy from an electron beam, which non-visible radiation excites a visible-light emitting phosphor particle.

There are several possible implementations of the ultraviolet-light emitting phosphor particles. Preferred are those phosphors that contain no visible light emission. Some examples of possible UV-phosphorescent core particles include: $Y_2Si_2O_7$:Ce, $LaPO_4$:Ce and $SrAl_{12}O_{19}$:Ce.

Exemplary Embodiment of the Layer of Non-Visible-Light Emitting Particles

An exemplary embodiment of the matrix of non-visible-light emitting particles (such as the matrix 1 non-visible-light emitting particles 3 shown in FIG. 5) includes a layer of ultraviolet-light emitting phosphor particles coated with a black pigment, such as graphite. In this embodiment, the layer of black pigmented ultraviolet-light emitting phosphor particles performs the function of a traditional graphite black matrix, with the added benefit of actively exciting an adjacent visible-light emitting phosphor with the ultraviolet light emitted upon excitation by an electron beam.

This embodiment performs functions similar to those of the traditional graphite matrix in that it masks imperfections in the overlying phosphor stripe and permits a greater electron-beam pathway across the phosphor than would a non-matrix display. However, while the traditional black matrix typically consists of black carbon graphite, the UV-Matrix is comprised partially or entirely of a special phosphor that emits ultraviolet light when excited by electron beam. The emitted non-visible light is a secondary means of exciting the adjacent phosphor particles, with electron beam itself being the primary means.

Fabricating the UV-Matrix

The present invention provides several possible embodiments for fabricating UV matrices (e.g., the UV-matrix 1 of FIG. 5).

For example, the UV-Matrix can be applied to the glass panel via a slurry, electrostatic charge or other method similar to current carbon-graphite matrix applications, with the slurry coating method being preferred. The slurry method typically involves the following multiple steps: (1) exposing a photosensitive film, e.g., polyvinylpyrrolidone and 4,4diazidostilbene 2,2-disodium sulfonate (PVP-DAS), to ultraviolet light through a mask; (2) developing the unexposed portion of the film, in this case with water; and (3) coating the black-matrix solution over the cured photoresist.

Chemical agents, e.g., hydrogen peroxide, subsequently applied to the panel leach through the dried black-matrix film and break down the underlying, cured photoresist, rendering a black-matrix consisting of columns, or other geometric shapes, surrounded by a black frame or border. This is commonly known as a "CRT black matrix."

After applying the UV-Matrix of the present invention to the panel glass in this fashion, the phosphor stripes are then screened atop the UV-Matrix, just as is the case with a traditional CRT display. The UV-Matrix preferably consists of small-particle size phosphors (e.g., less than 3 microns) to ensure a picture sharpness and uniformity comparable to that currently provided by the traditional black-matrix.

Once the UV-Matrix CRT is assembled and switched on, each electron beam will strike its corresponding colored phosphor and overlap slightly into the UV-Matrix that borders the phosphor region. Wherever the electron beam strikes the UV-Matrix on the panel, those regions will emit ultraviolet light that will, in turn, excite the bordering or adjacent phosphor area. The UV light will excite only the phosphor on the "near" side of the matrix stripe, not the "far" side.

The adjacent phosphor area will then be excited through two distinct mechanisms: electron-beam excitement and UV-light excitement. Since the extent of UV emission is limited to the colored-phosphor region immediately adjacent to the matrix, there is no color bleeding. For example, the UV-Matrix that is excited around a particular green-phosphor area will not affect an adjacent blue-phosphor area, due to the UV-light absorption that occurs within the rest of UV-Matrix that remains unexposed to the electron beam.

Alternative Embodiment

In another embodiment of the present invention, the UV-Matrix (for example, like the matrix 1 seen in FIG. 5) is formed by using mixture of UV-emitting phosphor particles and graphite particles. This embodiment of the UV-Matrix is slightly more difficult to achieve than the previous graphite-coated embodiment, due to particle-dispersion concerns. However, this method can be more economical, as the UV phosphor may not have to undergo a molecular graphite-coating process.

Alternative Embodiment

Figure 6:
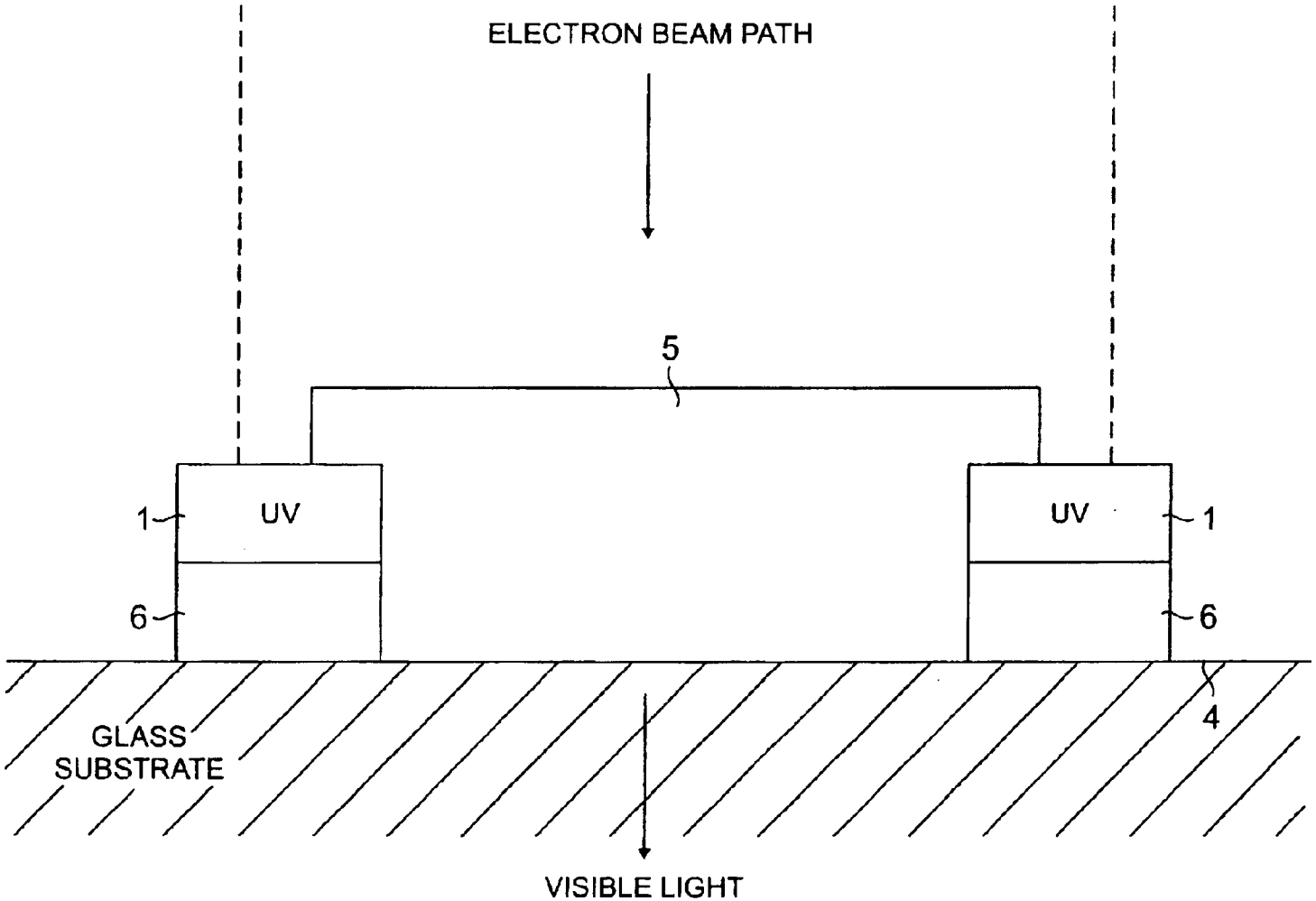
FIG. 6 depicts an exemplary embodiment of an electron beam interaction with a phosphor containing visible-light emitting phosphor particles and a UV-Matrix containing non-visible-light emitting particles according to one aspect of the present invention.

In another embodiment of the present invention, as seen in FIG. 6, the UV-Matrix is formed by coating a UV-emitting phosphor film over a conventionally prepared graphite film to yield a UV-matrix 1 over a traditional graphite black matrix 6, which can then be used to activate phosphor 5. The primary advantage to this method is the ease with which it can be implemented into current CRT manufacturing lines. The disadvantage is a decrease in UV light that actually reaches the colored phosphors, for example, due to the fact that more phosphor particles are located (in this embodiment) at a slight diagonal from the UV-emitting phosphor.

Alternative Embodiment

Figure 7:
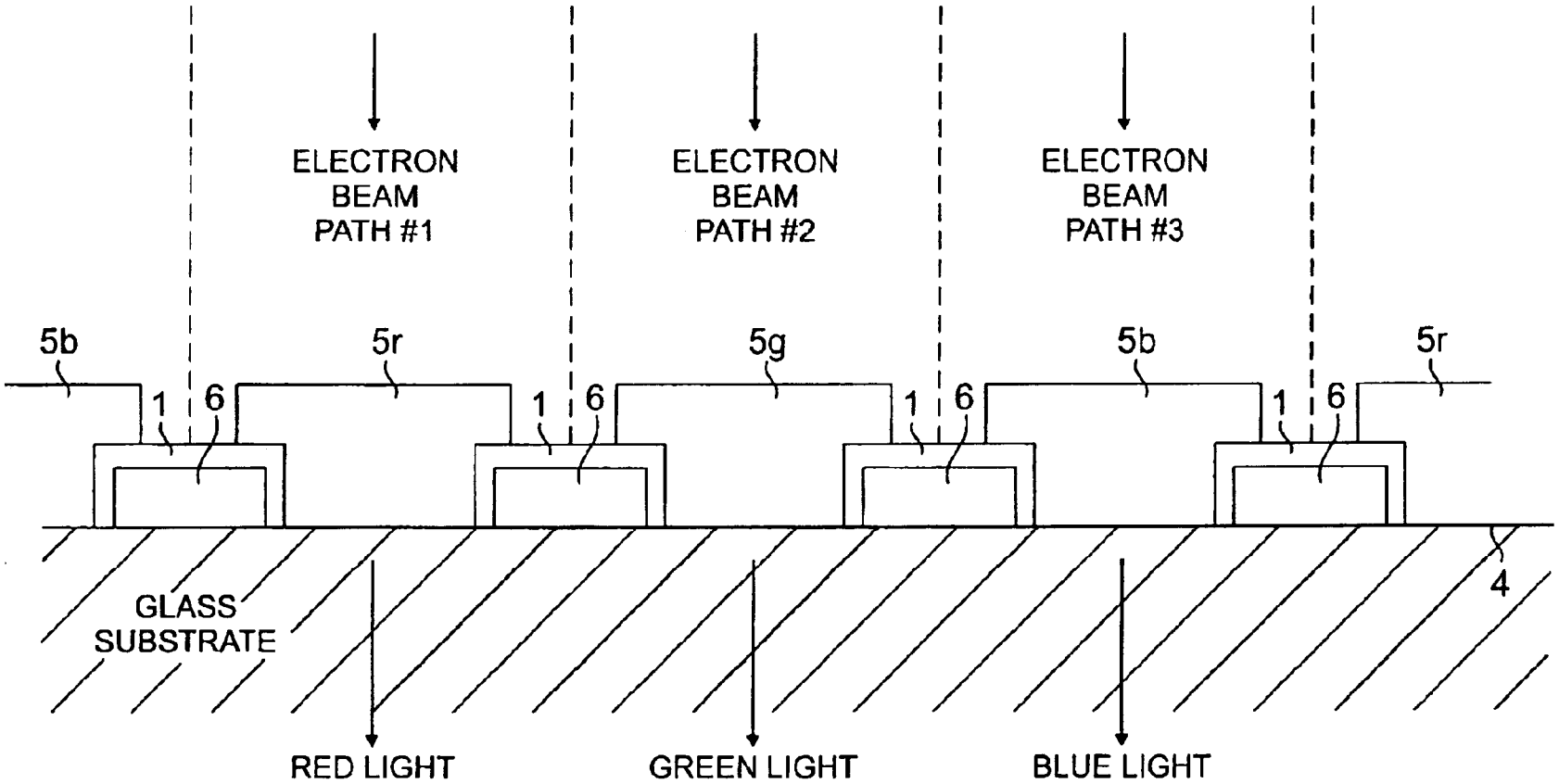
FIG. 7 depicts an exemplary embodiment of electron beams interacting with phosphors containing visible-light emitting phosphor particles and a UV-Matrix containing non-visible-light emitting particles according to one aspect of the present invention.

In another embodiment of the present invention, as seen in FIG. 7, a UV-Matrix is created by first creating a traditional black-matrix 6 with slightly-enlarged phosphor windows, then coating the periphery of the matrix area with a thin border 1 of pigmented, UV-emitting phosphor. In FIG. 7, electron beam #1 is shown striking red phosphor 5*r*, electron beam #2 is shown striking green phosphor 5*g* and electron beam #3 is show striking blue phosphor 5*b*, producing red, green and blue light, respectively. While an advantage to this method is a substantial decrease in material costs for the UV-emitting phosphor, it also has the disadvantage of requiring an additional significant manufacturing step.

Back Embodiment

According to another exemplary embodiment of the invention, some of the energy from the electron beam strikes non-visible-light emitting particles that are disposed in a layer on a gun side of the visible-light emitting phosphor.

This causes the non-visible-light emitting particles to emit non-visible radiation, at least some of which reaches the visible-light emitting phosphor. The non-visible radiation excites the visible-light emitting phosphor causing it to output visible light.

In addition, some of the electron beam energy passes through the layer containing the non-visible-light emitting particles and reaches the visible-light emitting phosphor. The electron beam energy adds to the total excitation energy received by the visible-light emitting phosphor, further exciting the visible-light emitting phosphor particles and causing them to increase their visible light output. In other words, the electron beam excites the visible-light-emitting phosphor through a different physical mechanism than does UV-excitation. Accordingly, the total energy that actually strikes the visible-light-emitting phosphor is actually less than that in a traditional CRT—because some of the total energy of the electron beam is absorbed by the UV phosphor. However, as a result of this dual excitation the electron beam energy from the gun can now be safely increased so that the total energy reaching the visible phosphor is normalized with traditional CRT values. In contrast, if one increases the electron beam energy in a traditional CRT, without any other changes, damage to the visible phosphor may result.

Hence, the energy that passes through the non-visible-light emitting particle layer (which is normally not captured by the side embodiment discussed above) is converted to illumination energy as a result of this aspect of the present invention, which accounts for the increase in energy conversion efficiency. Electron beam energy that is not absorbed by the UV phosphor will impact the visible phosphor.

To demonstrate the efficiency of this dual excitation concept, let us suppose that 100 energy units impact the UV phosphor. Then, suppose that 30% of this energy is absorbed by the UV phosphor. Of the 70% remaining that reaches the visible-light-emitting phosphor, 10% (i.e., 10% times 70%) of that energy will be converted to visible light. Of the 30% absorbed by the UV phosphor, 10% will be converted to UV light. Of this UV energy, 10% will be converted to visible light. Thus, of the original 100 units of electron beam energy, 7 units (10% times 70%) are converted to visible light via electron beam excitation, while 0.3 units (30% times 10% times 10%) are converted to visible light via UV excitation. The numbers in this example are used for demonstrative purposes only. The actual numbers may vary.

Side and Back Embodiment

Figure 8:
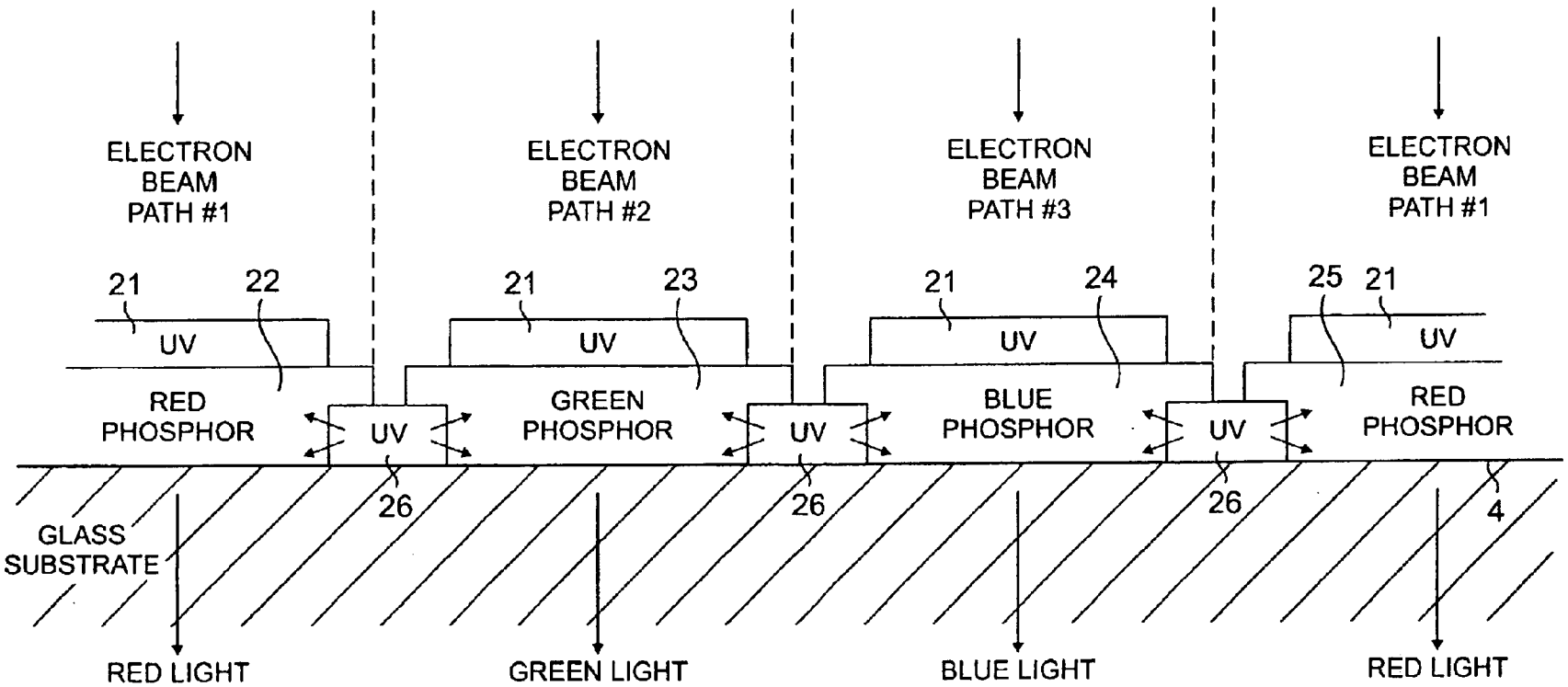
FIG. 8 depicts another exemplary embodiment of an electron beam interaction with the phosphor particles according to one aspect of the present invention.

According to another exemplary embodiment of the invention, the side and back embodiments may be combined to form an excitation mechanism in which energy from a single electron beam causes at least three different modes of excitation. Referring to FIG. 8, shown therein is an example of the three modes.

First, the electron beam strikes a layer 21 of non-visible-light emitting particles (also referred to herein as a Back UV Matrix), which causes these particles to output non-visible radiation, which in turn strikes the particles in the visible-light emitting phosphors 22–25 and thereby illuminates the visible-light emitting phosphors 22–25.

Secondly, some of the electron beam passes through the layer 21 of non-visible-light emitting particles and reaches the visible-light emitting phosphors 22–25, thereby further exciting the visible-light emitting particles therein.

Thirdly, some of the electron beam energy reaches the matrix 26 of non-visible light emitting particles disposed at the sides of visible-light emitting phosphors 22–25. This causes the non-visible light emitting particles within matrix 26 to output non-visible radiation that excites particles in the visible-light emitting phosphors 22–25 from the sides, further increasing their light energy output.

In this embodiment, the particles within the non-visible-light emitting layer 21 behind the visible-light emitting phosphors 22–25 may be the same as or different from the non-visible-light emitting particles in matrix 26 disposed adjacent to the side of the visible-light emitting phosphors.

Figure 9:
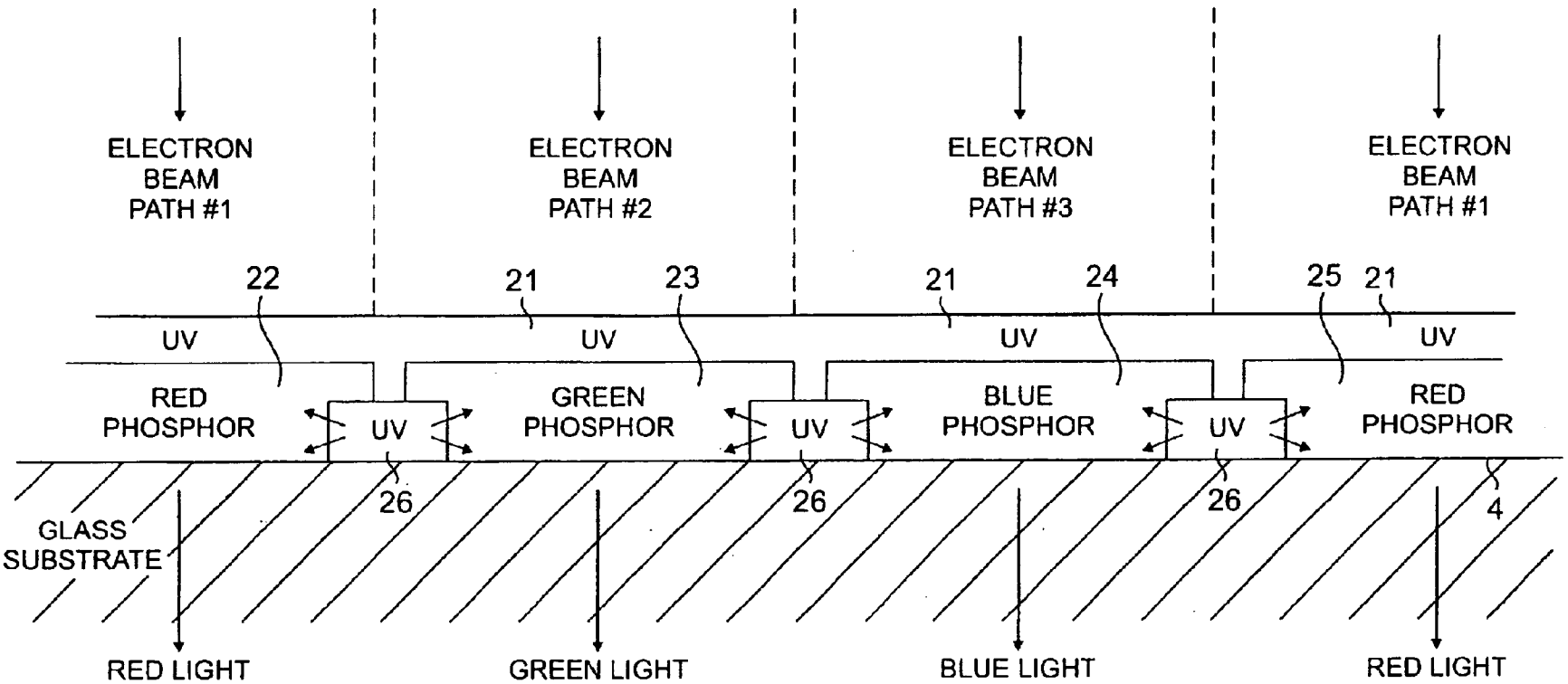
FIG. 9 depicts yet another exemplary embodiment of an electron beam interaction with the phosphor particles according to another aspect of the present invention.

The UV-phosphor does not have to be limited to stripes atop existing stripes. For example, the UV-Phosphor may be a uniformly coated layer over all existing stripes, as shown in FIG. 9.

Furthermore, the UV-Phosphor 26 may be UV-Phosphor mixed with another dark matrix material or dark colored material. Alternatively, the UV-Phosphor region 26 may be made exclusively of UV-emitting phosphor.

Alternative Embodiment

Yet another embodiment of the Back UV-Matrix involves coating the entire inside, viewable region of the panel with UV-emitting phosphors after applying a black matrix (for example, a graphite-comprising UV-Matrix or a traditional graphite black matrix) and visible-light phosphors, or without any matrix at all.

Alternative Embodiments

As previously noted, the Back UV-Matrix provides an additional UV-emitting phosphor boundary behind the phosphor (e.g., stripe or dot) itself. This type of UV-Matrix would preferably consist of UV-emitting phosphor with a much smaller particle size than the particles used in the visible (e.g., green/blue/red) phosphors. The smaller particle size would optimize the electron beam absorption by the UV-emitting phosphor and allow for a greater portion of the electron beam to reach the larger-particles within the green/blue/red phosphors on the panel glass. Also, for reasons of particle packing, the overcoat of smaller UV particles will fill porous areas of the underlying visible phosphor.

To minimize material costs, the Back UV-Matrix could be applied as a photoresist after all three colored phosphors are applied. An ultraviolet curing stage could be utilized with or without a shadow mask, followed by a developing sequence. The Back UV-Matrix can also be selectively screened over one or two particular colors of phosphor, or over selective regions of the screen.

Of course, additional combinations of the above embodiments are possible.

In the various embodiments of the invention, and particularly in the Back UV-Matrix embodiments, it is preferable to utilize small-particles (<about 4 microns ($\mu$)) of UV phosphor behind the phosphor stripe. In the Side UV-Matrix embodiments, the particle size is preferably even smaller (<about 2 microns ($\mu$)), with a black-pigment coating, such a graphite coating or mixture.

The above UV-Matrix concepts may be applied to other display devices, cathode ray tube, field emission display, etc. that utilize electron beam excitation of a phosphor.

High Definition Television and Four Color CRTs

As previously noted, the present invention helps to remedy the problem of decreases in cathode-ray-tube picture brightness as the phosphor display pixels are decreased in size due to higher resolution display requirements, such as in high definition television, or clue to the use of an additional pixel color.

The present invention is particularly beneficial to high-density displays since, at least in some embodiments, the phosphor is activated from the side of the phosphor stripe (or dot), as well as from behind. In these embodiments, the wider the phosphor stripe, the lower the percentage of illumination is across the stripe, since the penetration distance of the light from the side ultraviolet matrix is limited. Conversely, the narrower the phosphor stripe, the greater the impact of the adjacent ultraviolet matrix. Hence, the narrower phosphor stripes in high-definition CRTs and four-color CRTs makes the side-excitation mode particularly suitable for these displays.

The present invention is further beneficial in connection with four-color CRTs, due to the efficiencies of the phosphors used therein. Specifically, a high-voltage electron beam provides only one means of exciting phosphors currently utilized in the CRT display industry. As previously discussed, and in accordance with the presenting invention, another mechanism for exciting phosphors is through ultraviolet light energy.

As a specific example, one of the phosphor candidates for the fourth color of a display tube, $Y_2O_2S$:Pr, yields only approximately 6% energy conversion to visible light emission when excited by a high-voltage electron beam. However, when excited by ultraviolet light, the energy-to-visible light conversion is increased. Nevertheless, as the initial energy imparted by the electron beam is far greater than that rendered by the UV-Matrix's ultraviolet light, the overall contribution of the ultraviolet light is comparable or inferior to that of the electron beam. When dealing with highly efficient cathodoluminescent phosphors, such as ZnS:Ag (which is approximately 20% efficient when excited by an electron beam), the added benefit of the ultraviolet contribution is small. However, with less efficient cathodoluminescent phosphors, such as $Y_2O_2S$:Pr, the added benefit of ultraviolet excitation is substantial.

Although the above embodiments have been depicted and described using a single electron beam, the invention is equally applicable to displays employing multiple beams or sources of electrons. FEDs, for example, employ multiple mini electron beams that strike the phosphor. The invention is equally applicable to such devices. One could also converge two electron beams on the same point in a CRT. For example, implementations using multiple electron beam guns, e.g., six guns—two for each color—can be modified according to the present invention.

Although various embodiments are specifically illustrated and described herein, it will be appreciated that modifications and variations of the present invention are covered by the above teachings and are within the purview of the appended claims without departing from the spirit and intended scope of the invention.

What is claimed is:

1. A method for increasing image brightness in a cathode ray tube display comprising:

exciting a phosphor particle using a first excitation mode, wherein the first excitation mode comprises indirectly activating the phosphor particle; and exciting the phosphor particle using a second excitation mode, wherein the second excitation mode comprises directly activating the phosphor particle by striking the phosphor particle with an electron beam.

2. The method according to claim 1, further comprising exciting the phosphor particle using a third excitation mode.

3. The method according to claim 2, wherein the third excitation mode comprises indirectly activating the phosphor particle.

4. The method according to claim 3, wherein the first excitation mode indirectly activates the phosphor particle by activating a non-visible-light emitting particle disposed between a source of electrons and the phosphor particle, which non-visible-light emitting particle in turn activates the phosphor particle by emitting non-visible radiation, and the third excitation mode indirectly activates the phosphor particle by activating another non-visible-light emitting particle disposed adjacent the phosphor particle, which other non-visible-light emitting particle in turn activates the phosphor particle by emitting non-visible radiation.

5. The method according to claim 3, wherein indirectly activating the phosphor particle comprises activating a non-visible-light emitting particle which in turn activates the phosphor particle by emitting non-visible radiation.

6. The method according to claim 4, wherein the step of directly activating the phosphor particle comprises striking the phosphor particle with electrons that pass through a layer including the non-visible-light emitting particle.

7. The method according to claim 6, wherein the non-visible-light emitting particles comprise ultraviolet-light emitting phosphor particles.

8. The method according to claim 1, wherein indirectly activating the phosphor particle comprises activating a non-visible-light emitting particle which in turn activates the phosphor particle by emitting non-visible radiation.

9. The method according to claim 8, wherein the non-visible-light emitting particle comprises an ultraviolet-light emitting phosphor particle.

10. The method according to claim 1, wherein indirectly activating the phosphor particle comprises activating a non-visible-light emitting particle disposed between a source of electrons providing the electron beam and the phosphor particle, which non-visible-light emitting particle in turn activates the phosphor particle by emitting non-visible radiation.

11. The method according to claim 1, further comprising the step of employing one or more sources of electrons for each of the exciting steps.

12. The method according to claim 1, wherein the first and second excitation modes occur simultaneously.

13. A method for activating a phosphor stripe in a cathode ray tube comprising:

activating a light-emitting phosphor stripe by causing an electron beam to impinge on the phosphor stripe from behind the phosphor stripe; and activating the light-emitting phosphor stripe by causing an electron beam to impinge op a non-visible-light emitting phosphor strip adjacent to the phosphor stripe.

14. The method according to claim 13, further comprising employing one or more sources of electrons for each of the activating steps.

15. The method according to claim 13, wherein the electron beam impinges on the light-emitting phosphor stripe and the non-visible-light emitting phosphor stripe simultaneously.

* * * * *

UNITED STATES PATENT AND TRADEMARK OFFICE

CERTIFICATE OF CORRECTION

PATENT NO. : 6,717,346 B2
DATED : April 6, 2004
INVENTOR(S) : John Friedrich Breuninger It is certified that error appears in the above-identified patent and that said Letters Patent is hereby corrected as shown below:

Title page,
Item [57], ABSTRACT,
Line 9, change “die” to -- the --.

Column 3,
Line 29, before “invention”, change “presenting” to -- present --.

Column 4,
Line 49, before “phosphor”, change “(G/B)” to -- (B/G) --.

Column 5,
Line 64, before “phosphor”, change “(G/B)” to -- (B/G) --.

Column 7,
Line 54, before “UV-Matrix”, insert -- the --.

Column 8,
Line 19, before “striking”, change “show” to -- shown --.

Column 10,
Line 13, before “a graphic coating or mixture,” insert -- as --.
Line 22, after “television,” change “or clue to” to -- or due to --.
Line 41, before “invention,” change “presenting” to -- present --.

Column 12,
Line 31, after “impinge,” change “op” to -- on --.

Signed and Sealed this

Seventeenth Day of August, 2004

JON W. DUDAS
*Acting Director of the United States Patent and Trademark Office*